United States Patent [19]

von Beckmann

[11] Patent Number: 4,535,700

[45] Date of Patent: Aug. 20, 1985

[54] DEVICE FOR TAMPING RAILROAD TRACK ADJACENT THE TIE ENDS THEREOF

[75] Inventor: Helmuth von Beckmann, Columbia, S.C.

[73] Assignee: Canron Inc., Toronto, Canada

[21] Appl. No.: 343,331

[22] Filed: Jan. 27, 1982

Related U.S. Application Data

[63] Continuation-in-part of Ser. No. 235,032, Feb. 17, 1981, abandoned.

[51] Int. Cl.[3] ..... E01B 27/17

[52] U.S. Cl. ..... 104/12; 37/105; 104/7 A

[58] Field of Search ..... 104/7 A, 7 R, 10, 11, 104/12; 173/33, 67, 667, 742; 37/104, 105, 106, 277

[56] References Cited

U.S. PATENT DOCUMENTS

| | | | |
|---|---|---|---|
| 530,614 | 12/1894 | Burnham | 37/377 |
| 3,179,062 | 4/1965 | Christoff | 104/7 A |
| 3,457,660 | 7/1969 | Speno | 37/105 |
| 3,610,157 | 10/1971 | Plokhotsky et al. | 104/12 |
| 3,621,785 | 11/1971 | Fearon et al. | 104/7 A |
| 3,811,382 | 5/1974 | Buchter et al. | 104/7 R |
| 3,949,678 | 4/1976 | Theurer | 104/12 |
| 4,040,292 | 8/1977 | Theurer et al. | 104/12 |
| 4,090,451 | 5/1978 | Theurer | 104/12 |
| 4,111,129 | 9/1978 | von Beckmann | 104/12 |
| 4,125,075 | 11/1978 | Stewart | 104/7 R |
| 4,136,618 | 1/1979 | Boyer | 104/7 R |
| 4,170,942 | 10/1979 | Theurer | 104/12 |
| 4,196,532 | 4/1980 | Muller | 37/105 |
| 4,248,155 | 2/1981 | Theurer | 104/12 |
| 4,319,645 | 3/1982 | Totten | 172/742 |
| 4,403,430 | 9/1983 | Valditerra | 37/104 |

FOREIGN PATENT DOCUMENTS

| | | | |
|---|---|---|---|
| 1245810 | 9/1971 | United Kingdom | 104/12 |
| 222429 | 7/1968 | U.S.S.R. | 104/12 |
| 235800 | 4/1971 | U.S.S.R. | 104/12 |
| 319663 | 1/1972 | U.S.S.R. | 104/12 |
| 380777 | 7/1973 | U.S.S.R. | 104/12 |
| 578391 | 10/1977 | U.S.S.R. | 104/12 |
| 0592908 | 2/1978 | U.S.S.R. | 104/12 |
| 796295 | 1/1981 | U.S.S.R. | 104/7 A |

*Primary Examiner*—Robert B. Reeves
*Assistant Examiner*—Donald T. Hajec
*Attorney, Agent, or Firm*—Wenderoth, Lind & Ponack

[57] ABSTRACT

There is disclosed a tamping device for tamping railway track ballast adjacent and beneath the track tie ends. The device includes a track working machine, a retractable tamper frame mounted on the machine; the frame in operative position, extending, at least partially in the ballast, parallel to the center line of the track adjacent the outside the tie ends; a plurality of tamping plates mounted one behind the other longitudinally of the frame and extending inwardly thereof, in the direction of the track center, in stepped formation with a leading tamping plate extending farther from the frame inwardly towards the track center than a next adjacent trailing tamping plate. Each tamping plate has a leading edge and a trailing edge, one of the edges being flexibly connected to the frame and the other of the edges being connected to a tamping plate vibrator. A ballast plough is mounted at a leading end of said tamper frame. The plough has a rearwardly upwardly inclined ramp surface and a ballast share blade extends above the ramp surface and is inclined inwardly from a point adjacent the nose of the plough rearwardly towards the trailing end of the plough. Provision is made for swinging the plough or the share blade, or the tamper frame with the plough thereon, so as to alter the blade ploughing angle in the ballast. A ballast deflector flap may be provided at the leading end of the share blade to deflect superfluous ballast away from the tack center.

46 Claims, 16 Drawing Figures

DEVICE FOR TAMPING RAILROAD TRACK ADJACENT THE TIE ENDS THEREOF

This is a continuation in part of application Ser. No. 235,032 filed Feb. 17, 1981, now abandoned.

BACKGROUND OF THE INVENTION

This invention relates to devices for continuously tamping the track adjacent the tie ends thereof whilst a track working machine moves steadily along the track. In one aspect the invention relates to devices in which the tamping action which, compacts the ballast, is utilized for a track lifting and a track lateral alignment function. Examples of patents showing continuous tamping whilst the track working machine moves along the track are the Buchter and Jaeggi U.S. Pat. No. 3,811,382 issued May 21, 1974 and Plokhitsky et al U.S. Pat. No. 3,610,157. The patent which shows lifting and aligning of the track by compaction adjacent to the tie ends is the Stewart U.S. Pat. No. 4,125,075 issued Nov. 14, 1978.

The prior art devices whilst being effective in their tamping procedures have been some what inefficient in their ballast handling and wasteful of power.

SUMMARY OF THE INVENTION

According to the present invention there is provided a tamping device for tamping railway track ballast adjacent the track tie ends, comprising a track working machine; a tamper frame mounted on the machine; the frame, in operative position, extending substantially parallel to the rails of the track adjacent the tie ends thereof; a plurality of longitudinally extending tamping plate members mounted one behind the other on the frame and extending inwardly thereof towards the track center in stepped formation; each tamping plate member having a leading edge and a trailing edge, one of the edges being flexibly connected to the frame and the other of the edges being connected to a plate vibrator means.

Conveniently the trailing edge of a trailing tamping plate member may be substantially at the same distance from the tracks centre as the leading edge of the preceeding tamping plate member.

According to a preferred feature of the invention there is provided means to adjust the attitude of at least one plate member relative to the tamper frame. Conveniently this may be means for altering the position, transversely of the track, of the trailing edge of at least one tamping plate member. The means for altering the position of the tamping plate member may be on the tamper frame.

In one preferred form of the invention the vibrator means may comprise an individual vibrator element for each plate member, at least one of which elements may be provided with extensible means, operable to rotate at least one plate member about its flexible connection to move its trailing edge closer to the track center and, conveniently, each extensible means may be operable to rotate each plate member about its flexible connection to move the trailing edge of selected plate members differentially closer to the track centre. In a preferred embodiment a reference system is provided to control the extensible means, which reference system that may conveniently include means to detect the degree of ballast compaction adjacent each individual ballast plate member.

According to one feature of the invention the reference system may comprise a micro-processor comparator means for each side of the track, which comparator means is arranged to receive, as a first input, a derived signal of track surface condition, as a second input a derived signal of track lateral alignment condition and, optionally, as a third input a derived signal of ballast density at a point of track tamping, the comparator means weighs the input and produces track condition correcting command signals to at least one of a track lifting jack means, a track aligning jack means, and the plate member attitude adjusting means, whereby to work the track and correct its surface and alignment condition.

The present invention also contemplates a method of continuously tamping a railroad track which method comprises consolidating a first portion of the ballast by forcefully displacing a second portion of ballast inwardly towards the track centre line and towards the first portion by passing tamping blade means through the ballast adjacent the tie ends, and consolidating the second portion of ballast by forcefully displacing a third portion of ballast inwardly towards the track centre line and said second portion by passing a second tamping blade means, stepped outwardly from the first blade means in a direction away from the track centre line, through the ballast adjacent the tie ends.

In one preferred form the method comprises the steps of moving the first portion of ballast from outside, or from below and adjacent, the tie ends upwardly towards the tracks centre line and consolidating the first portion by forcefully displacing a second portion of ballast inwardly towards the track centre line and towards the first portion by passing tamping blade means through the ballast adjacent the tie ends.

According to a feature of the invention the operative area of each succeeding tamping plate member may be greater than that of the plate member preceeding it and conveniently the plate members may be of rectangular configuration, or in another preferred alternative, the plate members may be tapered so as to increase the plate member area from its leading edge to its trailing edge.

Preferably the tamping plate members are mounted with the trailing edge of each plate member closer to the track centre than the leading edge of each plate member.

According to a preferred form of the invention there is provided a tamping device for tamping railway track ballast adjacent and beneath the track tie ends, comprising a track working machine; a retractable tamper frame mounted on the machine; the frame, in operative position, extending substantially parallel to the centre line of the track adjacent and outside the tie ends thereof; a plurality of tamping plate means mounted one behind the other longitudinally of the frame and extending inwardly thereof, in the direction of the track center, in stepped formation, with a leading tamping plate means extending farther from the frame inwardly towards the track center than a next adjacent trailing tamping plate means; each tamping plate means having a leading edge and a trailing edge, one of the edges being flexibly connected to the frame and the other of the edges being connected to a tamping plate means vibrator means. Conveniently three tamping plate means are provided and the vibrator means for the leading edge plate means may be a higher speed vibrator than the vibrator means for the second and trailing tamping plate means.

Preferably also the means mounting the tamping frame on the track working machine should include means to move the entire frame inwardly of the track towards the track center against the resistance of the ballast, and also include means to adjust the frame angular position outwardly of the machine about an axis parallel to the track center line.

BRIEF DESCRIPTION OF THE DRAWINGS

The following is a description by way of example of certain embodiments of the present invention reference being had to the accompanying drawings in which.

DESCRIPTION OF PREFERRED EMBODIMENTS

Figure 1:
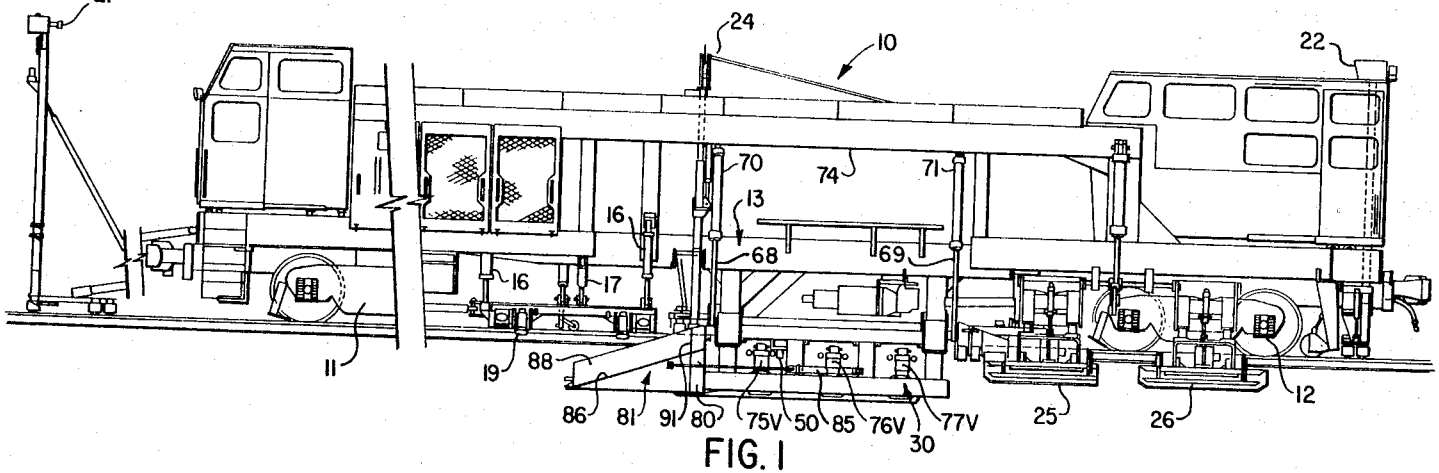
FIG. 1 is a side elevation of a track working machine incorporating a tamping device.

Turning now to the drawings, a self-propelled track working machine 10 has front and rear rail engaging bogies 11 and 12 mounted on the main chassis 13. The track working machine is provided with track lifting and lateral aligning jacks 16, 17 of conventional form, which operate on the rails through roller clamps 19, similar of known form. The track working machine is provided with reference systems for track level and alignment of conventional form. The track level system being exemplified by an infra-red beam projector 21 and receiver 22, with a shadow board 24 therebetween at the measuring point.

Shoulder compactor dressing units 25,26, also of conventional form, are provided adjacent the rear bogey 12.

Mounted on the machine chassis 13, at either side of the chassis in transverse lateral alignment, are a pair of tamping frames 30, only one of which is shown in FIG. 1, the other frame being a duplicate of the illustrated frame.

Figure 2:
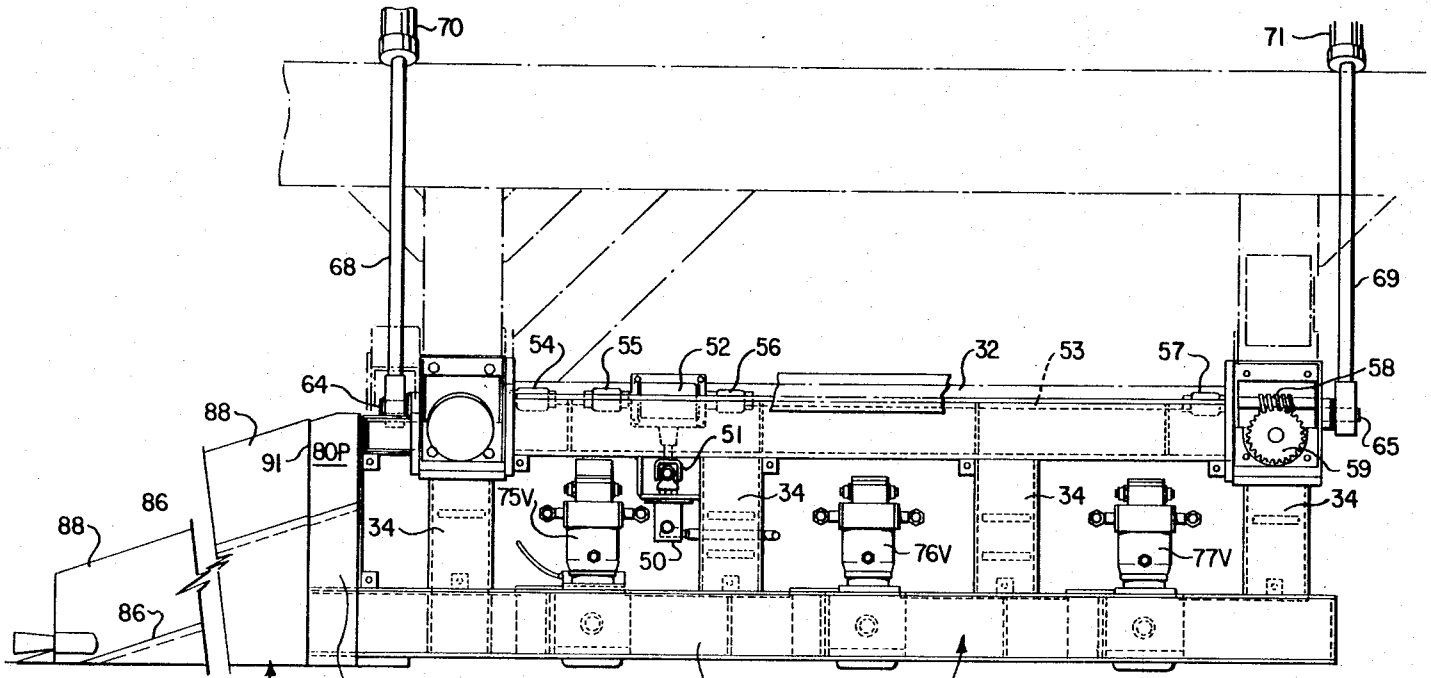
FIG. 2 is a detail side elevation, to an enlarged scale, showing the tamping device.

Turning to FIG. 2 the ballast tamping frame 30 is essentially of box like construction having a lower beam member 31 and an upper beam member 32 connected by a series of upright frames 34. The box like tamping frame 30 is mounted on the chassis 13 for telescoping movement towards and away from the track center on a support structure 35 (see FIG. 3) which has two transversely extending sleeve members 36,37 pivotally mounted at 38,39 to members 40 and 41 of the lower beam 43 of the chassis 13 of the machine. The tamper frame 30 is connected to the tubular numbers 36,37 by means of the inner slide members 46,47 which are telescopically received within sleeves members 36,37.

Figure 3:
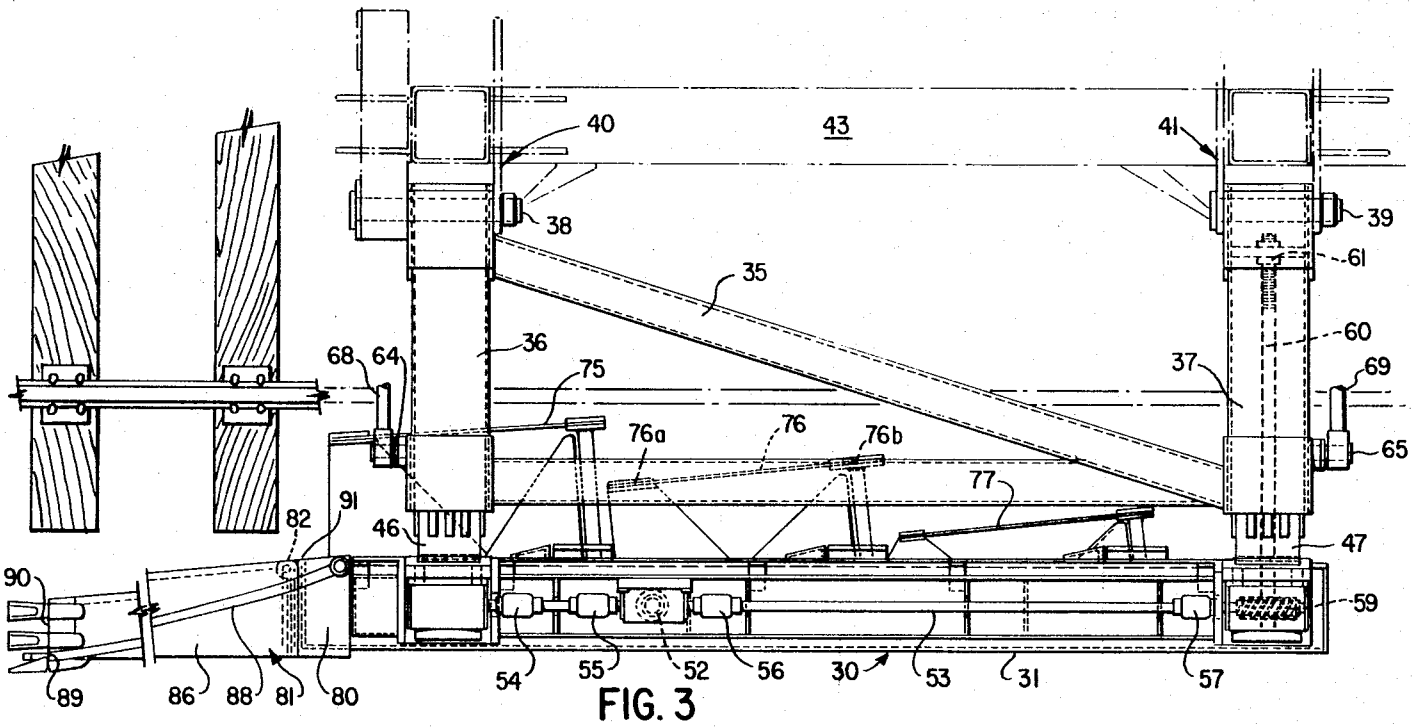
FIG. 3 is a plan view of the tamping device shown in FIG. 2.

A hydraulic motor 50 (see FIG. 2) drives, through a universal joint 51 and gear connection 52, a shaft 53 journaled in bearings 54,55 56,57 and carrying at either end a worm gear 58 (one of which is shown in FIG. 2). Each worm gear 58 meshes with a pinion gear 59 mounted on a transverse shaft 60 (one of which is shown in FIG. 3). The shaft 60 extend through the slide members 46,47 within the sleeves 36,37 and into nuts 61 anchored to sleeves 36 and 37 respectively.

The sleeves 36,37 have outer stub shafts 64,65 to which are pivotally connected the outer ends of the piston rods 68,69 extending from hydraulic cylinders 70 and 71 respectively. The upper ends of the cylinders 70,71 are pivotally connected to an upper beam 74 of the chassis 13 of the machine.

The tamping frame 30 on its lower beam 31 carries three ballast tamping plate members 75,76,77. As seen in FIGS. 3 and 4 the tamping plates 75,76 and 77 have leading edges 75*a*, 76*a* and 77*a* and trailing edges 75*b*, 76*b* and 77*b*. In the configuration shown in FIGS. 3 and 4 the trailing edges 75*b*, 76*b* and 77*b* are, when the tamping frame is in its operative position as shown in FIG. 1, closer to the center line of the track than their respective leading edges 75*a*, 76*a* and 77*a*. Extensions 75*c*, 76*c* and 77*c* of the beam 31 extend inwardly from the beam 31 towards the center of the track and the leading edges 75*a*, 76*a* and 77*a* respectively are flexibly connected thereto so that the plates 75, 76 and 77 flex about their connections.

The connection 75*a* is a hinged connection, whereas the connections 76*a* and 77*a* are elastic connections. A mixture of connections may be used or they may all be uniform. A preference is for a uniform arrangement of hinges such as shown at 75*a*. Conveniently a ripper tooth 75*t* may also be provided.

The trailing edges 75*b*, 76*b* and 77*b* of the tamping plate members 75, 76 and 77 are operatively clamped to the outer end of vibrator drive connecting rod members 75*g*, 76*g* and 77*g*, the big ends of which are connected to eccentrics driven by vibrator motors 75*v*, 76*v* and 77*v*. As shown, the trailing edge 76*b* is substantially in line with leading edge 75*a*, and trailing edge 77*b* is substantially in line with leading edge 76*a*. One big end 77*h* and its associate eccentric 77*k* is shown at the right hand side of FIG. 4, the top of the motor 77*v* having been removed and it is to be understood that the rods 75*g* and 76*g* are similarly connected. The motors 75*v*, 76*v* and 77*v* are standard hydraulic vibrator motors which are mounted on the lower beam 31 of the beam 30 (see also FIG. 2) and as they rotate they drive the connecting rods, through their eccentrics to vibrate the tamping plates 75, 76 and 77 about their connected leading edges to impart the tamping action to the ballast. It is preferred, that the leading motor 75*v* be operated at a higher speed than the motor 76*v* and 77*v* to impart, through its eccentric, a higher vibration frequency to the plate 75 than is imparted to the plates 76,77. Ballast guide shields 75*s*, 76*s* and 77*s* are mounted on the beam 31 and extend inwardly therefrom towards the center line of the machine, when the tamping frame 30 is in operative position.

Figure 4A:
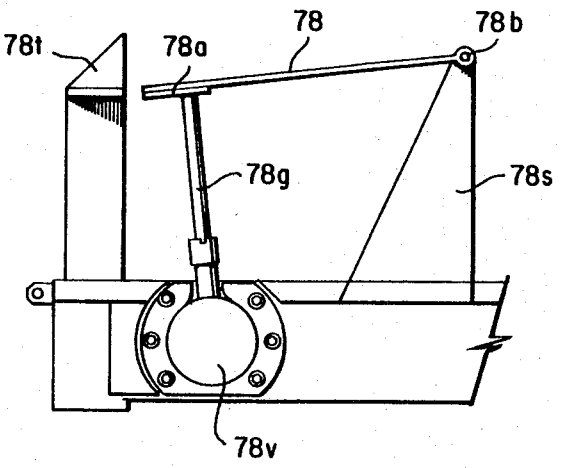
FIG. 4A is a detail, in plan, of an alternative type of tamping plate.
Figure 4:
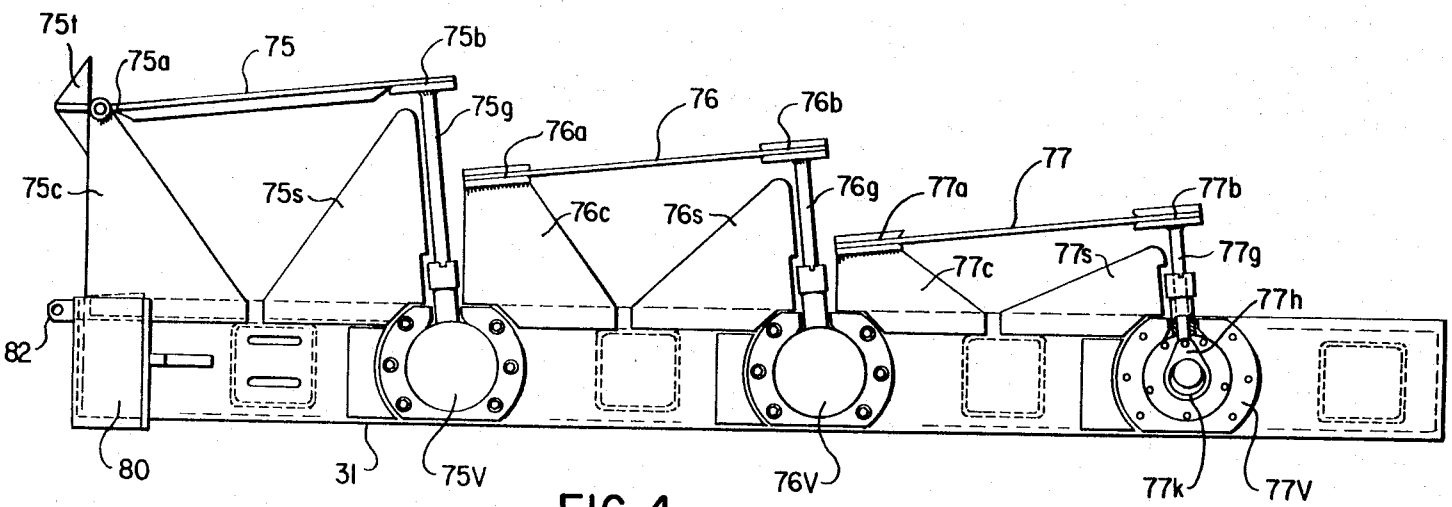
FIG. 4 is a plan view, similar to FIG. 3 and showing different types of tamping plate means and their vibrators in somewhat more detail and to a larger scale.

In FIG. 4*a* a further alternative type of construction for the tamping plates is shown. In this configuration a leading tamping plate 78 is flexibly connected by a hinge at its trailing edge 78*b* (rather than at the plate leading edge as in the constructions heretofore described) to the ballast guide shields 78*s* of the beam 31. The leading edge 78*a* is drivingly connected to the connecting rod member 78*g* of the vibrator motor 78*v*. As with the driving connections heretofore described, the motor 78*v* drives through an eccentric so as to oscillate plate 78 about its hinge 78*b* and provide a tamping action. A ripper tooth 78*t* is shown leading the plate 78. As before successive stepped tamping plates of the same configuration or of an alternative configuration are provided rearwardly on the beam 31.

The plate members 75,76 and 77 preferably are arranged one behind the other in stepped formation with the leading plate member 75 being closer to the center line of the track than the next adjacent trailing plate member 76; similarly with the plates 76 and 77.

Figure 5:
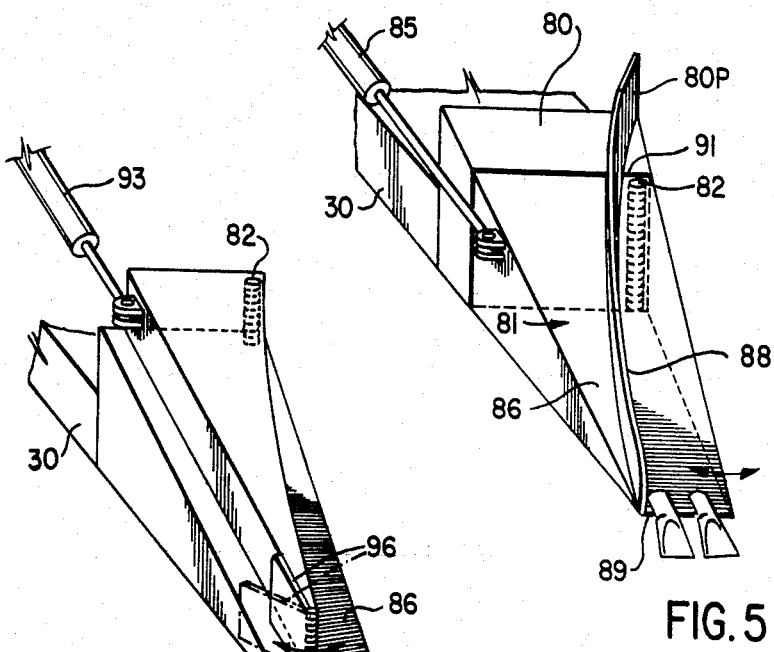
FIG. 5 is a detail of a plough device.

At the leading end of the tamping frame 30 is a plough receiving member 80. A plough 81 (see also FIG. 5) is pivotally connected to the tamping frame 30 by means of a hinge 82 on the member 80 (see also FIGS. 2, 3 and 4). The plough 81 is pivoted about the vertical axis provided by the hinge 82 by a hydraulic piston and cylinder arrangement 85 (see also FIG. 1) connected between plough and tamping frame. The plough 81 has a rearwardly upwardly inclined ramp surface 86. A ballast share blade 88 extends upwardly above the ramp 86 surface and extends substantially diagonally across the ramp surface from a point 89 adjacent the nose 90 of the plow inwardly relative to the machine chassis towards the trailing edge 91 of the plough. Preferably the share blade is slightly concavely curved and preferably also, the member 80 has a ballast deflector plate 80*p*.

Figure 6:
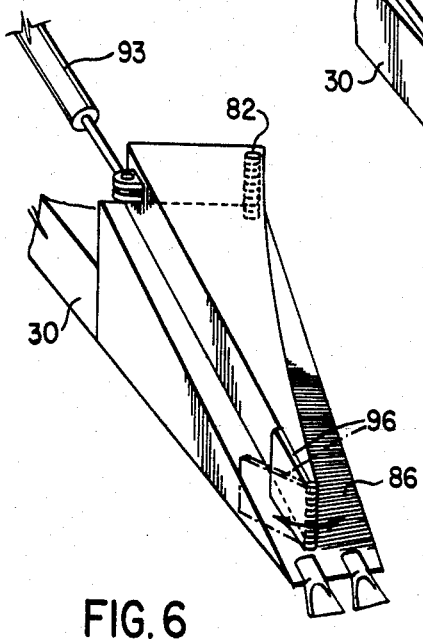
FIG. 6 is a detail of an alternative form of plough device.

In FIG. 6 an alternative arrangement is shown in which the plough 81 is rigidly connected to the member 80 and the share blade 88 moves across the ramp surface 86 under the action of the hydraulic piston and cylinder 93. A ballast deflector flap 96 is shown hingedly mounted to the nose of the share blade about a substantially vertical axis, a piston and cylinder device (not shown) is provided to swing the trailing edge of the flap away from the share blade, that is from the full line position shown in FIG. 6 to the dotted line position.

Figure 3A:
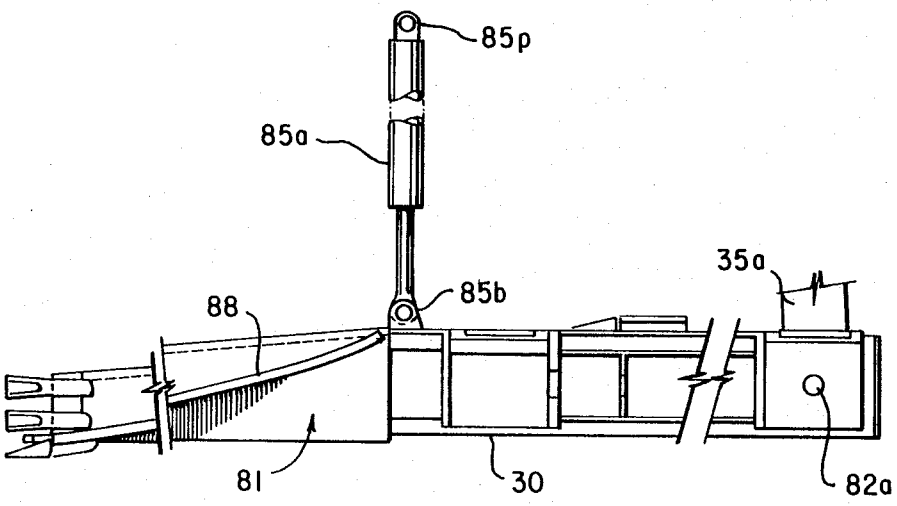
FIG. 3A is a schematic view somewhat similar to FIG. 3 but showing a different form of mounting.

FIG. 3A shows a further alternative arrangement. Here the plough 81 is rigidly connected to the tamper frame 30 and the share blade is rigidly connected to the ramp surface 86. The tamper frame 30 is pivoted about a substantially vertical pivot at 82*a* to a support structure 35*a* of the chassis 13. A hydraulic piston and cylinder arrangement 85*a* is pivoted at 85*p* to the machine chassis 13 and at 85*b* to the frame 30, to swing frame 30, and the plough 81 thereon with its share blade 88, about pivot 82*a*.

Figure 8:
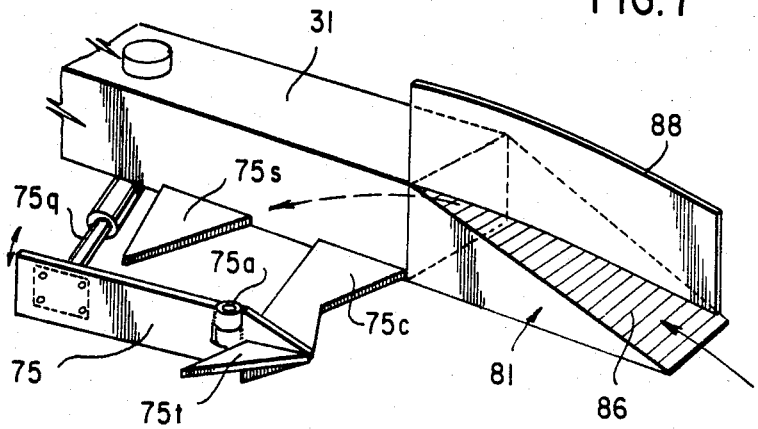
FIG. 8 is an illustration, in perspective, of a rigid plough and a leading tamping plate.

FIG. 8 shows an arrangement similar to that shown in FIG. 3A the plough 81 with its share blade 88, being rigidly attached to the beam member 31 of the frame 30 and a tamping unit such as illustrated in FIG. 4 being provided.

The operation of the device will now be described. Ballast is dumped on each side of the section of track to be corrected, adjacent the tie ends and cylinders 70 and 71 are operated to angularly rotate the tamping frame 30 from its retracted position down into the operative position as shown in FIG. 1 about its pivot points 38, 39 which provide an axis parallel to the center line of the track.

Figure 7:
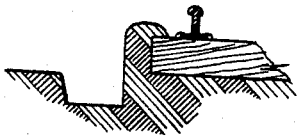
FIG. 7 is a schematic section, of the ballast after operation of the plough device and before tamping.

Depending upon the track condition and the amount of ballast available adjacent to the track shoulders, the frame 30 will be lowered into the ballast and is usually maintained at a slight angle to the vertical outwardly from the base of the track so as to tilt the ramp surface 86 slightly inwardly towards the track. The hydraulic motor 50 is operated to move the tamping frame 30 inwardly towards the track to provide the desired degree of compaction of the ballast and the vibrator motors 75*v*, 76*v* and 77*v* are operated. As the machine moves forward, that is to say from right to left as seen in FIG. 1, the nose of the plough 81 digs into the ballast and provides a trench like formation (see FIG. 7) to provide for the passage of the lower part of the lower frame member 31 of the tamping frame 30 in the ballast. The cylinder 85 is operated to adjust the position of the plough 81 about its vertical hinge 82 so as the share blade will cause the ballast which is moved up the ramp 86 by forward movement of the machine, to be directed inwardly towards the rails of the track. (It is of course understood that if the configuration according to FIG. 6 is employed, the cylinder 93 will be operated to adjust the angle of the share blade on the ramp 86. Similarly if the configuration of FIG. 3A is utilized, the cylinder 85 will be operated to pivot the frame 30 to adjust the angle of attack of the plough and share blade). It it's observed that too much ballast is being moved in towards the rails either the angle of the ramp 86 and/or the share blade 88 may be adjusted or the deflector flap 96 may be operated to deflect superfluous ballast away from the rail. In this position the extension 75*c* and the leading edge 75*a* with its ripper tooth 75*t* of the leading vibrator plate 75 cut through the ballast beneath the tie ends as best seen in FIG. 3. The ballast provided by the plough is now tamped by the vibration action of the plate 75 which is vibrated at some suitable frequency say between 35 and 50 Hz. This is preferably higher than the frequency of vibration of the trailing tamping plate members 76, 77. The leading tamping blade 75 loosens the existing ballast in the track bed and causes it to flow into the voids and make the ballast from the plough flow into place. The second and third vibrator plates 76 and 77, because they are operated at a lower frequency than the frequency of vibration of the plate number 75, consolidate the ballast and finally the ballast is shaped and compacted at the shoulders by the compactors 25 and 26 mounted in the machine behind the tamping frame 30.

In one mode of operation the lifting and aligning jacks 16 and 17 are under the control of the reference systems to position the track but in a preferred mode of operation the hydraulic motors 50 are under the control of the reference systems and the lifting and aligning jacks 16 and 17 are disengaged. In this econd mode of operation the hydraulic motors 50 operate to move the tamping frames 30 on either side of the track towards and away from each other to provide the required amount of lift and the required amount of alignment in a manner described in the Stewart U.S. Pat. No. 4,125,075 issued Nov. 14, 1978.

Although three vibrators plates 75, 76 and 77 have been shown for each tamping frame, it is to be understood that less or more tamping plate members could be utilized and similarly whilst the preferred stepped configuration of tamper plates has been described, it is to be understood that other stepped relationships may be desirable in certain applications, for example, in certain types of ballast.

Figure 9:
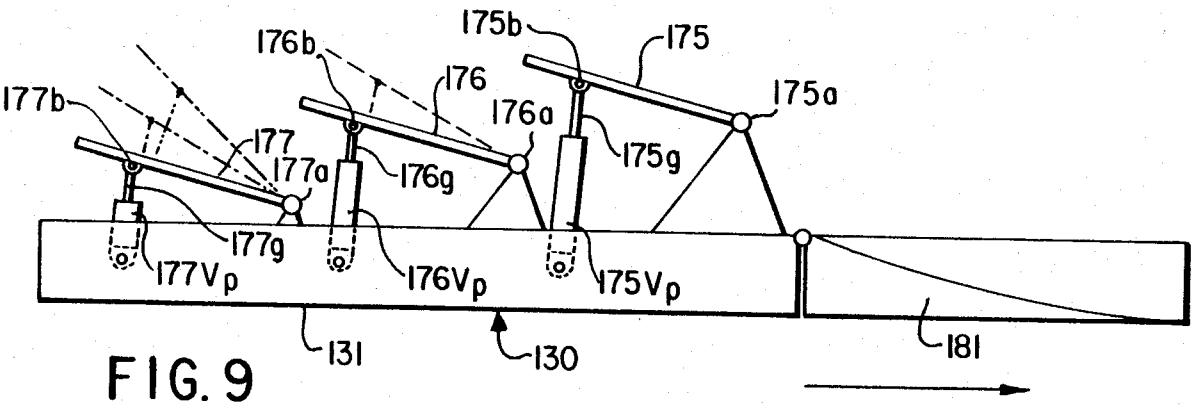
FIG. 9 is schematic plan view of an alternative form of tamper configuration.
Figure 10:
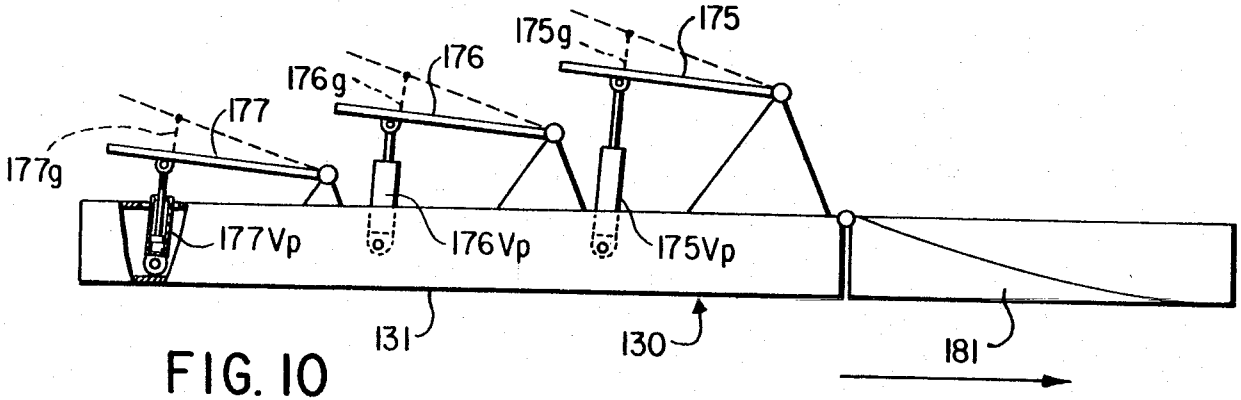
FIG. 10 is a view similar to FIG. 9 but showing the tamping plate members in a different operational condition.

Turning now to FIGS. 9 and 10. A ballast tamping frame 130 is again essentially of box like construction having a lower member 131. The box like tamping frame 130, conveniently, may be mounted on the chassis 13 for telescoping movement towards and away from the track center on a support structure as has been described with reference to FIGS. 1, 2 and 3. A plow 181 similar to the plow hereinbefore described may conveniently be mounted at the leading end of the tamping frame 130. The machine proceeds in the direction of the arrows.

The tamping frame 130, on its lower beam 131, carries three ballast tamping plate members 175, 176, 177 having, as shown, pivotly mounted leading edges 175*a*, 176*a*, 177*a* and trailing edges 175*b*, 176*b*, 177*b*, the configuration being similar to that shown in FIG. 4. However, in this instance, the trailing edges 175*b*, 176*b*, and 177*b*, are connected to the extensible piston rods 175*g*, 176*g*, 177*g* of a suitable vibrating means, conveniently a pulsating hydraulic vibrator motors 175V*p*, 176V*p*, 177$V_p$. The piston rods 175*g*, 176*g* and 177*g* of the pulsators, in addition to providing the vibratory motion, are capable of being extended so that the pulsators are capable of providing pulsating vibration at various piston rod extension lengths. As the machine proceeds in the direction of the arrow and it is desired to increase the volume of ballast displaced by the tamping plate members 175, 176, 177 from outside, or from below and adjacent the tie ends, towards the track centre, the extensible piston rods 175*g*, 176*g* and 177*g* may be extended to rotate the tamping plate members 175, 176, 177 about their pivot points 175*a*, 176*a*, 177*a* to occupy new positions, as shown in FIG. 10. In that Figure the tamping plate members 175, 176, 177 are shown, in full line, at a nominal operating angle, say, 6° relative to a line parallel to the track centre line. In the dotted line position the tamping plate members 175, 176, 177 can be seen to have taken up a new angle, say 8° after extension of rods 175*g*, 176*g* and 177*g*. At this new angular position, the volume of ballast swept by the plate members, that is to say displaced inwardly towards the track center, is greater than at the 6° position because the plate members exhibit a greater area to the ballast to be moved.

In FIG. 9 the tamping plate members 175, 176, 177 are shown in full line at a nominal operating condition, say, 8°. Where it is desired to increase the compaction of the ballast beneath the track, one or more of the piston rods 175*g*, 176*g*, 177*g* may be extended. In the configuration shown in FIG. 9 the tamping plate 175 has retained its original angle of 8°, piston rod 176*g* has been extended to rotate the tamping plate member 176 about its pivot point 176*a* to occupy an angle of, say, 10° and piston rod 177*g* may have been extended to cause plate 177 to take up a similar position of 10° (the first dotted line position in FIG. 9) or may have been extended yet further to rotate plate member 177 about its pivot point 177*a* to occupy an angle of, say, 12° (the second dotted line position shown in FIG. 9). Thus, the frontal area of plate 175 determines the initial compaction of the ballast and, blade 176 being of similar regular area but rotated through a greater angle, displaces a greater amount of ballast supplied by the plow blade, into a smaller volume, thereby compacting the ballast to a higher degree than that compacted by the tamping plate member 175. The trailing plate member 177, if it has been further extended to the 12° position will displace even more ballast into the trail of blade 176, thereby further compacting the ballast.

Figure 12:
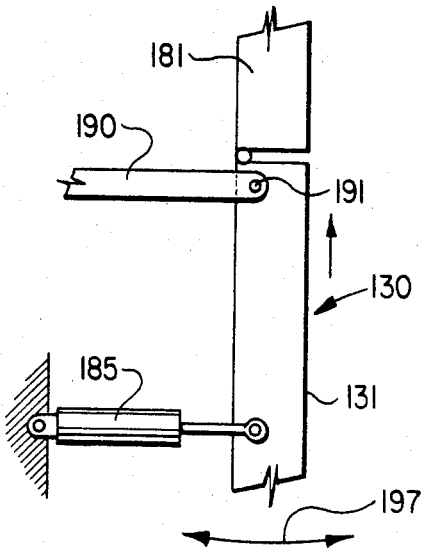
FIG. 12 is a schematic plan view of an alternative form of attachment of a tamping frame to the track working machine.

It may be that the machine will encounter certain ballast conditions in which even a greater degree of ballast compaction is required than that obtainable by extending blades 175, 176, 177 to their maximum fanned condition (as seen in FIG. 9) and to this end, the entire tamper box frame 130 may be pivotally mounted on a transversely extending bracket 190 (see FIG. 12) and pivotted about its pivot point 191 on the bracket 190, in the manner indicated by arrow 197 by means of a hydraulic piston cylinder 185 connected between the machine frame and the tamper box frame 130.

The tamper plates 75(175), 76(176), 77(177) need not necessarily be of similar configuration and equal area. In sketch 11*a* the tamping plate members are of rectangular configuration but of different area; they are increasing from the front to the rear so that the area of blade 76 (176) is larger than the area of blade 75 (175) and area of blade 77 (177) is larger than the area of blade 76(176).

Figure 11A:
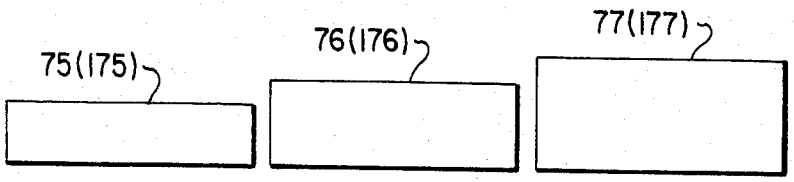
FIGS. 11*a* and 11*b* are schematic views of different blade frontal area configurations looking from the front of the track working machine rearwardly along its direction of travel, the center line of the track being to the left of the FIGS. 11*a* and 11*b;*
Figure 11B:
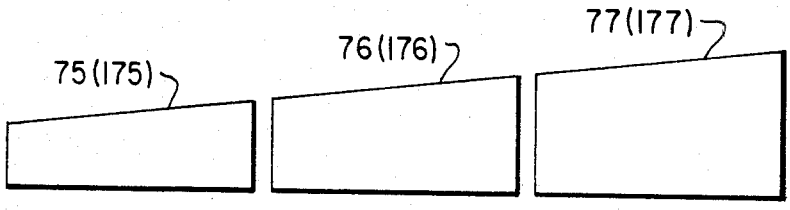

In FIG. 11*b*, a different configuration of blade is shown in which the top edge of the tamping plate members 75(175), 76(176), 77(177), is tapered so as to increase the plate member area, again the configuration being that the leading blade 75(175) has a smaller area than the next succeeding blade 76(176) which in turn has a lesser area than the last blade 77(177), and so on if required.

Figure 13:
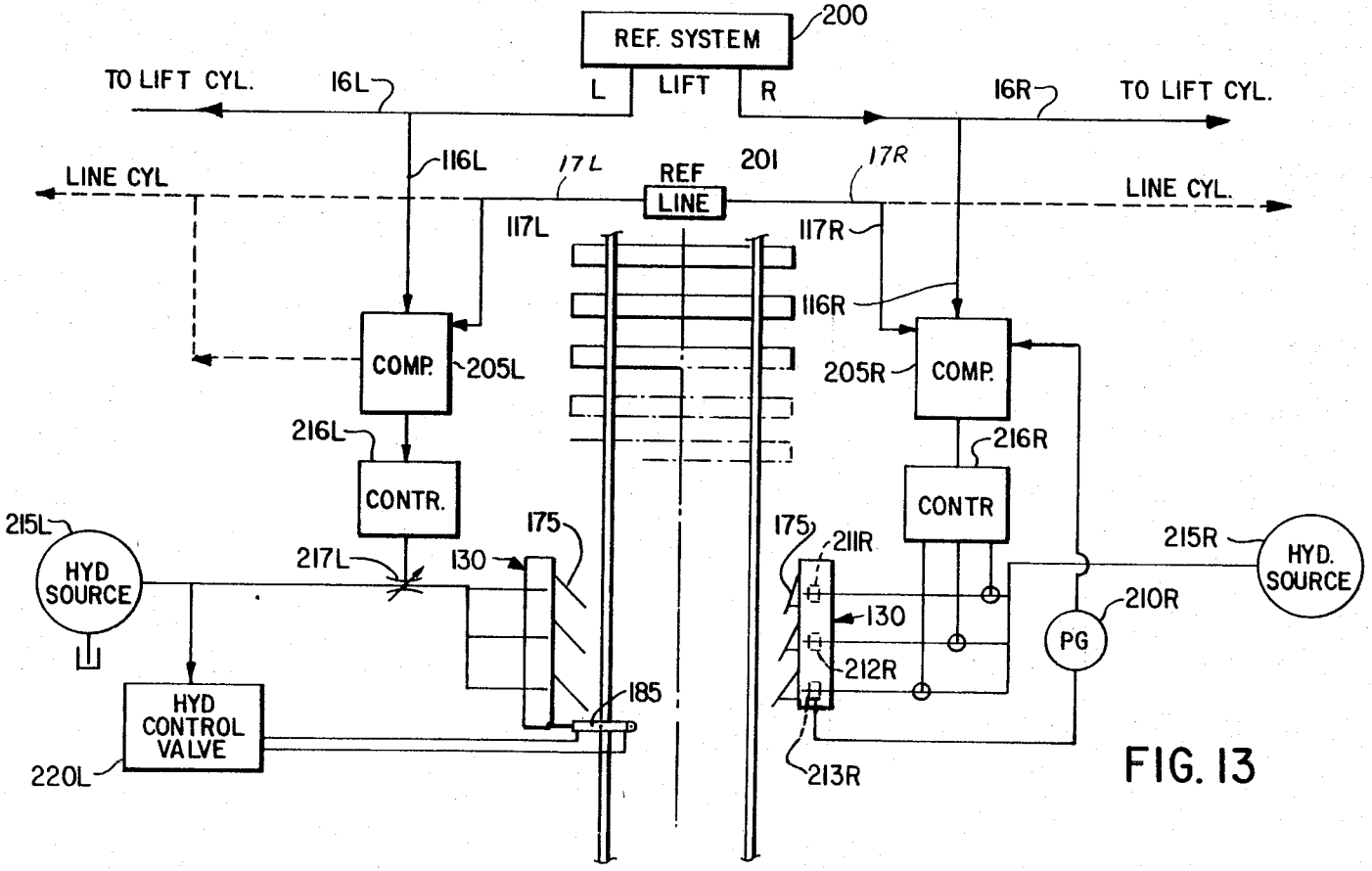
FIG. 13 is a schematic view of a reference control system, the right hand side of the Figure showing the system in one mode of operation and the left hand side of the Figure showing the reference system and a second mode of operation.

A reference and control system is shown schematically in FIG. 13, with the right hand portion of the Figure showing the system in one mode of operation and the left hand side of the Figure showing the system in a second mode of operation.

A track surface condition reference system indicated at 200, which may be of any conventional sort, for example the light beam transmitter 21, differential receiver 22, and shadow board 24 of FIG. 1, is arranged in usual fashion to transmit electrical signals to track lifting jacks, such as the jacks 16 for the left hand and right hand rails of the track along lines 16L, 16R.

A conventional track alignment reference system indicated at 201, which could be a usual light beam system, or a wire system, or any other suitable form of lining reference system, similarly transmits track alignment signals along lines 17L, 17R to track alignment cylinders, such as shown at 17, for the left hand and right hand rails of the track. The left hand and right hand signals from both systems 200 and 201 are transmitted to comparators 205L and 205R along lines 116L and 117L and 116R and 117R. The comparators 205L and 205R, conveniently, are microprocessor comparators of conventional form.

Looking now at the right hand side of the diagram in FIG. 13, a pessure gauge, PG, indicated at 210R, represents three pressure sensitive elements 211R, 212R, 213R, one in the hydraulics of each of pulsators 175V*p*, 176V*p*, and 177V*p* (See FIGS. 9 and 10) and which provide to the pressure gauge 210R, values of the ballast density in the area of the leading, intermediate, and trailing tamping plate members 175, 176, 177. These signals are transmitted from the pressure gauge 210 to the comparator 205R. The comparator 205R functions, in accordance with its program, to weigh the signals from the system 200 the system 201 the pressure gauge 210 and having weighed the derived input signals of track surface condition, track lateral alignment condition and track ballast density, transmits appropriate command signals through controller 216R, to correct the track condition to the right rail lifting cylinders 16 and/or the right rail line correcting jack 17 and, or exclusively, to pulsators 175*p*, 176*p*, 177*p*, to fan the plate members in a calculated one of the manners described with respect to FIG. 9. The sensors 211R, 212R, and 213R will provide indications of the difference of encountered ballast pressure at the leading, middle and trailing plate members 175, 176, 177 and the microprocessor comparator 205R will send signals to extend the extendsible rods 175*g*, 176*g*, 177*g* to varying lengths (and at corresponding speeds) to move their appropriate blades to the appropriate angles to produce the desired ballast compaction. Hydraulic fluid to pulse and extend the vibrators 175, 176, 177 is obtained from a suitable source, generally and schematically indicated at 215R, and the controller 216R functions to control the fluid flow from the source 215R.

Turning now to the left hand side of the sketch, a similar condition obtains at comparator 205L but in this mode of operation it is desired to move the tamper plate members 175, 176, 177 in parallel, that is to say to extend them to occupy an equal angle so as to move more ballast inwardly but without increasing compaction. For the purpose of simplicity the pressure gauge 210 has been omitted. Comparator 205L, as with comparator 205R, receives signals from the system 200, and 201 and accordingly transmits command signals via controller 216L to the lift and/or line cylinders 16, 17 and, or exclusively, to control throttle valve 217L to extend the tamping plate members 175, 176, 177 and equal amount in the manner described with respect to FIG. 10. Hydraulic fluid for the operation and extension of the hydraulic pulsators 175V*p*, 176V*p* and 177V*p* is obtained from a hydraulic source schematically shown as 215L operating through a hydraulic control valve box 220L and the valve 217L. The processor 205L may call for the displacement of more ballast beneath the track than can be accomodated by the extension of plate members 175, 176, 177 to their limit, at which time the hydraulic control valve box 220L operates to supply pressure to piston and cylinder 185. This operates to rotate the entire tamper frame 130 about its pivot point 191 (See FIG. 12) to assume a configuration which will accommodate for the condition required.

Obviously the reference control system of FIG. 13 could be programmed to operate in any particular fashion but will normally be arranged to function so that the lifting and aligning of the track is accomplished by the action of the tamping plate members on the ballast to lift and align the track. The method followed is the consolidation of a first portion of the ballast by forcefully displacing a second portion of ballast with a forward moving tamping plate member adjacent the tie ends inwardly and towards the first portion, and consolidating the second portion of ballast by forcefully displacing a third portion of ballast inwardly towards the second portion by passing a second tamping plate member through the ballast adjacent the tie ends. If more compaction of ballast is required the tamping plate members are extended. The lining control command signals from the comparators 205R and 205L are such as to permit one side or the other of the track to receive a greater pressure to move it transversly while the tamping plate members on either side of the track accomplish any required lifting of the track. However, in certain conditions, usually where an extraordinally large lift or shift of track is required, or where a peculiar ballast condition obtains, the comparators 205R and 205L may signal the lifting and aligning jacks 16 and 17 to assist the operation. Alternatively if desired, under certain conditions the comparators 205R, 205L can be arranged to order the majority of the lifting and aligning of the track to be accomplished by the lifting and aligning jacks 16 and 17.

It is also to be understood that the configurations of tamping plate members and their mountings could be other than those shown to accomplish the adjustment of the attitude of the plate members in order to carry out the track lifting and aligning operation, or method.

What I claim as my invention is:

1. A tamping device for tamping railway track ballast adjacent the track tie ends, comprising a track working machine; a tamper frame mounted on said machine; said frame, in operative position, extending substantially parallel to the rails of the track adjacent the tie ends thereof; a plurality of longitudinally extending tamping plate members mounted one behind the other on the frame and extending inwardly thereof towards the track center in stepped formation; each tamping plate member having a leading edge and a trailing edge, one of said edges being flexibly connected to said frame and the other of the edges being connected to positive displacement plate vibrator means mounted on said frame to drivingly vibrate the tamping plate relative to said frame.

2. A device according to claim 1 in which the tamping plate members are mounted with the trailing edge of each plate member closer to the track center, when the device is in operative position, than is the leading edge of each plate member.

3. A device as claimed in claim 2 in which the leading edge of each plate member is flexibly connected to a projection of the frame which extends inwardly towards the track center and the trailing edge is connected to said vibrator means mounted on said frame.

4. A device as claimed in claim 3 wherein said vibrator means comprises a motor driven eccentric shaft, the outer end of which is operatively connected to the trailing edge of the vibrator plate member.

5. A device as claimed in claim 3 in which at least one of the vibrator means is provided with extensible means, operable to rotate at least one plate member about its flexible connection to move its trailing edge closer to the track center.

6. A device as claimed in claim 5 in which each vibrator element is provided with extensible means, operable to rotate each plate member about its flexible connection to move its trailing edge closer to the track center.

7. A device as claimed in claim 6 in which each extensible means is operable to rotate each plate member about its flexible connection to move the trailing edge of selected plate members differentially close to the track center.

8. A device as claimed in claim 5, or claim 6 or claim 7 further comprising a reference system to control said extensible means.

9. A device as claimed in claim 8 further comprising a reference system to control said extensible members, which system includes means to detect the degree of ballast compaction adjacent each individual ballast plate member.

10. A device as claimed in claim 5 further including a reference system to control said extensible means, said reference system comprising a micro-processor comparator means for each side of the track, which comparator means receives, as a first input, a derived signal of track surface condition, as a second input, a derived signal of track lateral alignment condition and weighs said inputs and produces track condition correcting command signals to at least one of a track lifting jack means, a track aligning jack means and said extensible means, whereby to work said track and correct its surface and alignment condition.

11. A device as claimed in claim 2 in which the trailing edge of each plate member is flexibly connected to a projection of said frame which extends inwardly towards the track center and the leading edge is connected to said vibrator means mounted on the frame.

12. A device as claimed in claim 11 wherein said vibrator means comprises a motor driven eccentric shaft, the outer end of which is operatively connected to the leading edge of the vibrator plate member.

13. A device as claimed in claim 1 wherein the means mounting the tamper frame on the track working machine includes means to move the entire frame inwardly of the machine towards the track center against resistance of the ballast, and means to adjust the frame angular position outwardly of the machine about an axis parallel to the track center line.

14. A device as claimed in claim 1 in which similar tamper frames are provided on either side of the machine in transverse alignment with one another.

15. A tamping device as claimed in claim 1 in which the trailing edge of a trailing tamping plate member is substantially at the same distance from the track center line as the leading edge of the preceding tamping plate member.

16. A tamping device as claimed in claim 1 in which means is provided for altering the position, transversely of the track, of the trailing edge of at least one tamping plate member.

17. A tamping device as claimed in claim 16 in which the means for altering said position of the trailing edge of said tamping plate means comprises: drive means attached between said tamper frame and said track working machine for moving said frame inwardly and outwardly in a direction transversely of the track.

18. A device as claimed in claim 17 further comprising a reference system to control said means for moving said frame inwardly and outwardly.

19. A tamping device as claimed in claim 16 in which the means for altering said position of the trailing edge of said tamping plate means comprises: drive means attached between said tamper frame and said track working machine for moving the leading end of said frame inwardly and outwardly in a direction transversely of the track.

20. A device as claimed in claim 19 further comprising a reference system to control said drive means.

21. A device as claimed in claim 16 further comprising a reference system to control said means for altering the position of the trailing edge of said at least one tamping plate member.

22. A device as claimed in claim 1 in which the operative area of each succeeding tamping plate member is greater than that of the plate member preceding it.

23. A device as claimed in claim 22 in which said plate members are of rectangular configuration.

24. A device as claimed in claim 22 in which said plate members are tapered to increase plate members area from leading edge to trailing edge.

25. A tamping device for tamping railway track ballast adjacent and beneath the track tie ends, comprising a track working machine; a retractable tamper frame mounted on the machine; said frame in operative position, extending substantially parallel to the center line of the track adjacent and outside the tie ends thereof; a plurality of tamping plate means mounted one behind the other longitudinally of the frame and extending inwardly thereof, in the direction of the track center, in stepped formation with a leading tamping plate means extending farther from the frame inwardly towards the track center than a next adjacent trailing tamping plate means; each tamping plate means having a leading edge and a trailing edge, one of said edges being flexibly connected to said frame and the other of the edges being connected to positive displacement tamping plate means vibrator means mounted on said frame to drivingly vibrate the tamping plate means relative to said frame.

26. A device as claimed in claim 25 in which three tamping plate means are provided.

27. A device as claimed in claim 26 in which the vibrator means for the leading tamping plate means is a higher speed vibrator than the vibrator means for the second and trailing tamping plate means.

28. A device as claimed in claim 26 in which each tamping plate means is mounted with the trailing edge closer to the track center, when the device is in operative position, than its leading edge, each leading edge being clamped for flexing movement of the tamping plate means to an inwardly directed extension of said frame; and each trailing edge being drivingly connected to said vibrating means mounted on said frame.

29. A device as claimed in claim 25 wherein the means mounting the tamper frame on the track working machine includes means to move the entire frame inwardly of the machine towards the track center, against resistance of the ballast, and means to adjust the frame angular position outwardly of the machine about an axis parallel to the track center line.

30. A device as claimed in claim 25 in which similar tamper frames are provided on either side of the machine in transverse alignment with one another.

31. A tamping device for tamping railway track ballast adjacent and beneath the track tie ends, comprising a track working machine; a retractable tamper frame mounted on the machine; said frame in operative position, extending, at least partially in the ballast, substantially parallel to the center line of the track adjacent and outside the tie ends thereof; a plurality of tamping plate means mounted one behind the other longitudinally of the frame and extending inwardly thereof, in the direction of the track center, in stepped formation with a leading tamping plate means extending farther from the frame inwardly towards the track center than a next adjacent trailing tamping plate means; each tamping plate means having a leading edge and a trailing edge, one of said edges being flexibly connected to said frame and the other of the edges being connected to positive displacement tamping plate means vibrator means mounted on said frame to drivingly vibrate the tamping plate means relative to said frame; and a ballast plough mounted at a leading end of said tamper frame said plough comprising a rearwardly upwardly inclined ramp surface and a ballast share blade extending above said ramp surface from a point adjacent the nose of the plough rearwardly towards the trailing end thereof.

32. A device as claimed in claim 31, in which said tamper frame is pivotally connected, adjacent a trailing end thereof, to said machine, about an axis extending substantially vertically to the track, and means is provided to swing said leading end of said frame, with the plough thereon, towards and away from the center line of the track to alter the working angle of said share blade in the ballast.

33. A tamping device for tamping railroad track ballast adjacent the track tie ends, comprising a track working machine; a tamper frame mounted on said machine; said frame, in operative position, extending substantially parallel to the rails of the track adjacent the tie ends thereof; at least one longitudinally extending tamping plate member extending inwardly of the frame towards the track center, said tamping plate member having a leading edge and a trailing edge, one of said edges being flexibly connected to said frame and the other of the edges being connected to a positive displacement plate vibrator means mounted on said frame to drivingly vibrate the tamping plate member relative to said frame, and ripper tooth means extending inwardly of the tamping plate member adjacent the leading edge thereof.

34. A tamping device for tamping railway track ballast adjacent the track tie ends, comprising a track working machine; a tamper frame mounted on said machine; said frame, in operative position, extending substantially parallel to the rails of the track adjacent the tie ends thereof; a plurality of longitudinally extending tamping plate members mounted one behind the other on the frame and extending inwardly thereof towards the track center in stepped formation; each tamping plate member having a leading edge and a trailing edge, one of said edges being flexibly connected to said frame and positive displacement means mounted on the frame for drivingly vibrating the other of said edges relative to said frame and means to adjust the attitude of at least one plate member relative to said tamper frame.

35. A device as claimed in claim 34 wherein said attitude adjusting means as adapted to adjust the attitude of each plate member.

36. A device as claimed in claim 35 in which said attitude adjusting means is adapted to adjust the attitude of selected plate members selectively.

37. A device as claimed in claim 34, or claim 35, or claim 36 further comprising a reference system to control said attitude adjusting means.

38. A device as claimed in claim 34 further including a reference system to control said plate member attitude adjusting means, said reference system comprising a micro-processor comparator means for each side of the track, which comparator means receives, as a first input, a derived signal of track surface condition, as a second input, a derived signal of track lateral alignment condition weighs said inputs and produces track condition correcting command signals to at least one of a track lifting jack means, a track aligning jack means and said plate member attitude adjusting means, whereby to work said track and correct its surface and alignment condition.

39. A tamping device for tamping railway track ballast adjacent the track tie ends, comprising a track working machine; a tamper frame mounted on said machine; said frame, in operative positon, extending substantially parallel to the rails of the track adjacent the tie ends thereof; a plurality of longitudinally extending tamping plate members mounted one behind the other on the frame and extending inwardly thereof towards the track center in stepped formation; each tamping plate member having a leading edge and a trailing edge, one of said edges being flexibly connected to said frame and positive displacement means mounted on the frame for drivingly vibrating the other of said edges relative to said frame and means on the tamper frame to move the trailing edge of at least one plate member closer to the track center.

40. A device as claimed in claim 39 in which said trailing edge moving means is adapted to move the trailing edge of each plate member closer to the track center.

41. A device as claimed in claim 40 in which said trailing edge moving means is adapted to move the trailing edge of selected plate members selectively closer to the track center.

42. A device as claimed in claim 39, or claim 40, or claim 41 further comprising a reference system to control said trailing edge moving means.

43. A device as claimed in claim 39 further including a reference system to control said trailing edge moving means, said reference system comprising a microprocessor comparator means for each side of the track, which comparator means receives, as a first input, a derived signal of track surface condition, as a second input, a derived signal of track lateral alignment condition and weighs said inputs and produces track condition correcting command signals to at least one of a track lifting jack means, a track aligning jack means and said trailing edge moving means whereby to work said track and correct its surface and alignment condition.

44. A tamping machine as claimed in claim 38, 41 or 10 in which said compactor receives as a third input, a derived signal of ballast density at the point of track tamping.

45. A tamping device for tamping railway track ballast adjacent the track tie ends comprising a track working machine; a tamper frame mounted on said machine; said frame, in operative position, extending substantially parallel to the rails of the track adjacent the tie ends thereof; a plurality of longitudinally extending tamping plate members mounted one behind the other on the frame and extending inwardly thereof towards the track center in stepped formation; each tamper plate having a leading edge and a trailing edge; and driving means on the frame to positively displace at least one tamper plate member relative to said frame to drivingly vibrate said plate member.

46. A method of continuously tamping a railroad track, the track including rails fastened to spaced apart ties resting on ballast, which method comprises: consolidating a first portion of ballast by forcefully displacing a second portion of ballast inwardly towards the track center line and towards said first portion by passing first tamping blade means vibrated at a first frequency through the ballast adjacent the tie ends, and consolidating said second portion of ballast by forcefully displacing a third portion of ballast inwardly towards the track center line and said second portion by passing a second tamping blade means vibrated at a second frequency lower than said first frequency, stepped outwardly from the first blade means in a direction away from the track center line, through the ballast adjacent the tie ends.

* * * * *